US009661911B2

(12) United States Patent
Wu et al.

(10) Patent No.: US 9,661,911 B2
(45) Date of Patent: May 30, 2017

(54) STRAP CONNECTOR AND METHODS THEREOF

(71) Applicant: TUMI, Inc., South Plainfield, NJ (US)

(72) Inventors: Peter C. Wu, Sunnyside, NY (US); Paul V. Scicluna, Penndel, PA (US)

(73) Assignee: TUMI, INC., South Plainfield, NJ (US)

( * ) Notice: Subject to any disclaimer, the term of this patent is extended or adjusted under 35 U.S.C. 154(b) by 934 days.

(21) Appl. No.: 13/925,618

(22) Filed: Jun. 24, 2013

(65) Prior Publication Data

US 2014/0376992 A1 Dec. 25, 2014

(51) Int. Cl.

| | |
|---|---|
| ***A45F 3/00*** | (2006.01) |
| ***A44B 11/25*** | (2006.01) |
| ***A44B 13/00*** | (2006.01) |
| ***A44B 17/00*** | (2006.01) |
| ***A45C 13/00*** | (2006.01) |
| *A45F 3/02* | (2006.01) |

(52) U.S. Cl.

CPC ..... *A45F 3/00* (2013.01); *A44B 11/2584* (2013.01); *A44B 13/0017* (2013.01); *A44B 17/0011* (2013.01); *A45C 13/00* (2013.01); *A45C 13/001* (2013.01); *A45F 3/02* (2013.01); *A45F 2003/001* (2013.01); *Y10T 29/49826* (2015.01); *Y10T 403/32901* (2015.01)

(58) Field of Classification Search

CPC ..... A45F 3/02; A45F 2003/01; A45F 3/14; A45F 5/10; A45F 5/102; A45F 2005/1066; A45F 2005/026; A45F 3/047; A45C 13/001; Y10T 403/32901; Y10T 24/45812; Y10T 24/45984; Y10T 403/32057; Y10T 403/32073; Y10T 403/7005; Y10T 403/7015; A44B 13/0017; A44B 17/0011; A44B 11/2584; B65D 45/16; B60P 7/06; B60P 7/08; B60P 7/0807; B60P 7/0823; B61D 45/001

See application file for complete search history.

(56) References Cited

U.S. PATENT DOCUMENTS

| | | | | | |
|---|---|---|---|---|---|
| 653,397 | A * | 7/1900 | Pettijohn | E21B 17/046 | 24/581.12 |
| 1,271,963 | A * | 7/1918 | Vilandrer | A44B 17/0011 | 24/669 |
| 1,701,112 | A * | 2/1929 | Johnson | A44C 5/2038 | 24/643 |
| 2,477,575 | A * | 8/1949 | Bubser, Jr. | B64D 17/32 | 24/701 |
| 3,513,510 | A * | 5/1970 | Copes | A44B 11/2515 | 24/116 R |
| 3,728,764 | A * | 4/1973 | Carter | A44B 11/2511 | 24/642 |
| 4,362,414 | A * | 12/1982 | Volz | A45F 5/02 | 403/24 |

(Continued)

*Primary Examiner* — Joshua J Michener
*Assistant Examiner* — Matthew Gitlin
(74) *Attorney, Agent, or Firm* — Lando & Anastasi, LLP

(57) ABSTRACT

A strap connector for connecting a strap to an article is provided that may comprise a t-bar for attaching the strap to the article, a housing for receiving the t-bar, the housing secured to the article, the housing comprising a floor, and a bumper plate for maintaining the t-bar in a position within the housing, the bumper plate comprising a bumper protruding above the surface of the floor of the housing.

26 Claims, 8 Drawing Sheets

(56) References Cited

U.S. PATENT DOCUMENTS

| | | | | |
|---|---|---|---|---|
| 6,058,576 | A * | 5/2000 | Harris | A44C 5/2057 24/20 R |
| 6,141,841 | A * | 11/2000 | Workman | A45C 5/14 190/102 |
| 6,357,092 | B1 * | 3/2002 | Burrows | A44B 11/2584 24/265 WS |
| 6,626,623 | B2 * | 9/2003 | DeLay | B60P 7/0815 410/105 |
| 6,725,613 | B2 | 4/2004 | Oliver et al. | |
| 7,204,002 | B2 * | 4/2007 | Kaneko | A47D 13/025 24/614 |
| 7,334,959 | B2 * | 2/2008 | Holthaus | F16L 33/04 403/293 |
| 7,353,574 | B2 | 4/2008 | Wu et al. | |
| 8,944,189 | B2 * | 2/2015 | Puttmann | E21B 17/046 175/320 |
| 2004/0159208 | A1 * | 8/2004 | Yasunori | A44B 11/2584 84/329 |
| 2006/0048351 | A1 * | 3/2006 | Casebolt | A44B 11/253 24/634 |
| 2007/0252041 | A1 * | 11/2007 | Ebner | B64C 1/066 244/131 |
| 2015/0030386 | A1 * | 1/2015 | Carnevali | F16B 21/02 403/348 |
| 2015/0135492 | A1 * | 5/2015 | Chiang | A44B 11/28 24/598.1 |
| 2015/0337879 | A1 * | 11/2015 | Tucholke | F16B 1/00 24/303 |

* cited by examiner

STRAP CONNECTOR AND METHODS THEREOF

BACKGROUND OF THE INVENTION

Field of the Invention

Embodiments of the present invention generally relate to a strap connector and methods thereof. More specifically, embodiments of the present invention relate to a strap connector for securing a strap to an article with a t-bar.

Description of the Related Art

Straps are often attached to various articles to make carrying the articles easier. Many pieces of luggage, for example, employ the use of straps to allow a user to carry the weight of the luggage over his or her shoulder, rather than by hand. By supporting the article over the shoulder, the user may be able to support more weight because the luggage is supported mainly by the user's back and leg muscles, which are typically stronger than a user's arm muscles. In addition, the use of straps allows a user to free up their hands for other tasks.

Using straps has disadvantages, however, because the straps are often attached to the articles with connectors susceptible to tearing. For example, when the straps are rigidly attached to the articles with a piece of strap or webbing sewn directly to the article, the strap connection with the articles can easily tear and/or separate, causing the article to separate from the strap. Even when certain clips are used the clips can rub against the articles, causing tearing and/or other damage to the articles. These strap connectors can also easily get caught on other articles, and restricting movement of the articles.

Thus, there is a need for an improved strap connector that secures a strap to an article with a t-bar.

SUMMARY

Embodiments of the present invention generally relate to a strap connector and methods thereof. In one embodiment of the present invention, a strap connector for connecting a strap to an article may comprise a t-bar for attaching the strap to the article, a housing for receiving the t-bar, the housing secured to the article, the housing comprising a floor, and a bumper plate for maintaining the t-bar in a position within the housing, the bumper plate comprising a bumper protruding above the surface of the floor of the housing.

In another embodiment of the present invention, a strap connector for connecting a strap to an article may comprise a t-bar for attaching the strap to the article, the t-bar comprising a top bar adapted to attach to the strap, a bottom bar adapted to couple with the housing, and a t-bar connector adapted to attach the top bar and the bottom bar, a housing for receiving the t-bar, the housing secured to the article, the housing comprising a floor and rails for maintaining the t-bar within the housing; and a bumper plate for maintaining the t-bar in a position within the housing, the bumper plate positioned between the housing and the article, the bumper plate comprising a bumper protruding above the surface of the floor of the housing.

In yet another embodiment of the present invention, method of securing a strap to an article may comprise providing a strap connector comprising: a t-bar for attaching the strap to the article, a housing for receiving the t-bar, the housing secured to the article, the housing comprising a floor and rails for maintaining the t-bar within the housing, and a bumper plate for maintaining the t-bar in a position within the housing, the bumper plate positioned between the housing and the article, the bumper plate comprising a bumper protruding above the surface of the floor of the housing; attaching the strap to the t-bar; and attaching the t-bar to the housing.

BRIEF DESCRIPTION OF THE DRAWINGS

So the manner in which the above recited features of the present invention can be understood in detail, a more particular description of embodiments of the present invention, briefly summarized above, may be had by reference to embodiments, which are illustrated in the appended drawings. It is to be noted, however, the appended drawings illustrate only typical embodiments of embodiments encompassed within the scope of the present invention, and, therefore, are not to be considered limiting, for the present invention may admit to other equally effective embodiments, wherein.

Figure 1:
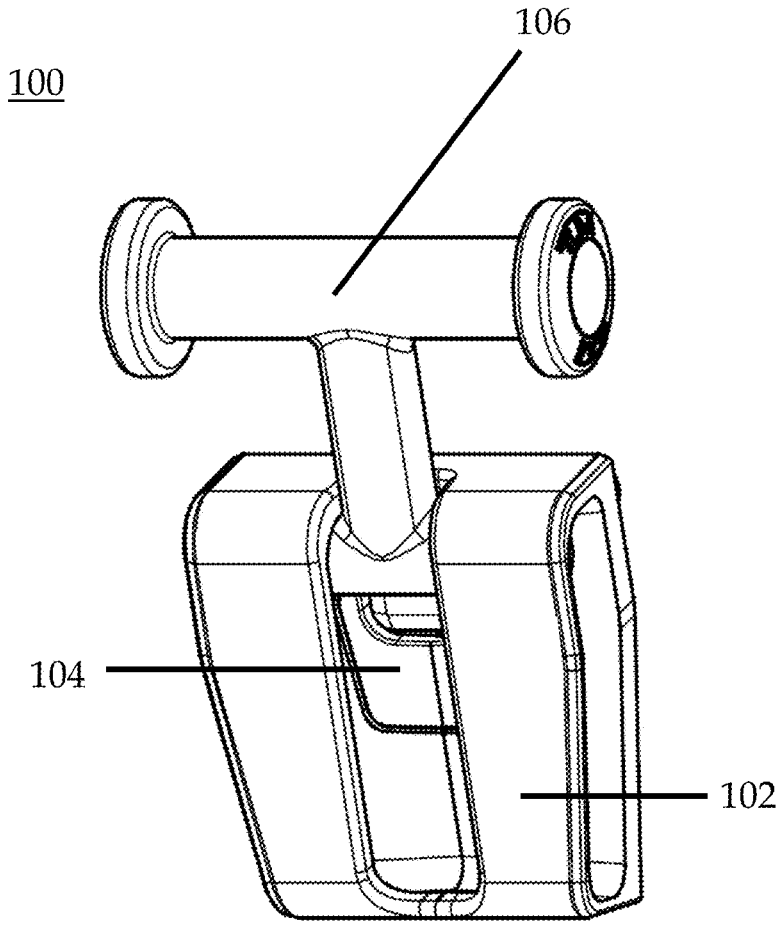
FIG. 1 depicts a perspective view of a strap connector in accordance with embodiments of the present invention.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION

Embodiments of the present invention generally relate to a strap connector and methods thereof. More specifically, embodiments of the present invention relate to a strap connector for securing a strap to an article with a t-bar. As used herein, the term "article" may refer to any article capable of being carried by a strap. By way of example, an article may include a bag, a case, a piece of luggage, a laptop bag, a purse, a duffel bag, an athletic bag, a shoulder bag, a satchel, a baguette bag, bowling bag, a golf bag, a bucket bag, a hobo bag, a messenger bag, a sling bag, a tote bag, a wristlet, a barrel bag, a flap bag, a frame bag, a double handle bag, a trapezoid bag, or any other object that can be carried by a strap, or the like.

FIG. 1 depicts a perspective view of a strap connector 100 in accordance with embodiments of the present invention. A strap connector 100 may be adapted to connect a strap and an article with a t-bar 106, allowing the t-bar 106 to rotate within the housing 102. The strap connector 100 may allow the strap to be rotationally moved when the t-bar 106 is rotated. In exemplary embodiments, the strap connector 100 may comprise a housing 102, a bumper plate 104, and a t-bar 106.

The housing 102 may be adapted to couple with the t-bar 106 and/or the bumper plate 104. In some embodiments, the housing 102 and the bumper plate 104 may be integral. The bumper plate 104 may be attached to and/or disposed on the article and may be adapted to secure the t-bar 106 at a location within the housing 102. The t-bar 106 may be adapted to attach a strap to the article. The t-bar 106 may be adapted to couple/decople with the housing 102 on one end and support a strap on the other end. The t-bar 106 may allow the strap to rotate when the t-bar 106 is coupled with the housing 102. The strap attached via the t-bar 106 may be provided with a greater range of movement than a strap attached directly to an article with a stitching, or the like. A bottom portion of the housing 102 and a bottom portion of the bumper plate 104 may be adapted to be secured to the article, for example, as shown in FIG. 2.

Figure 2:
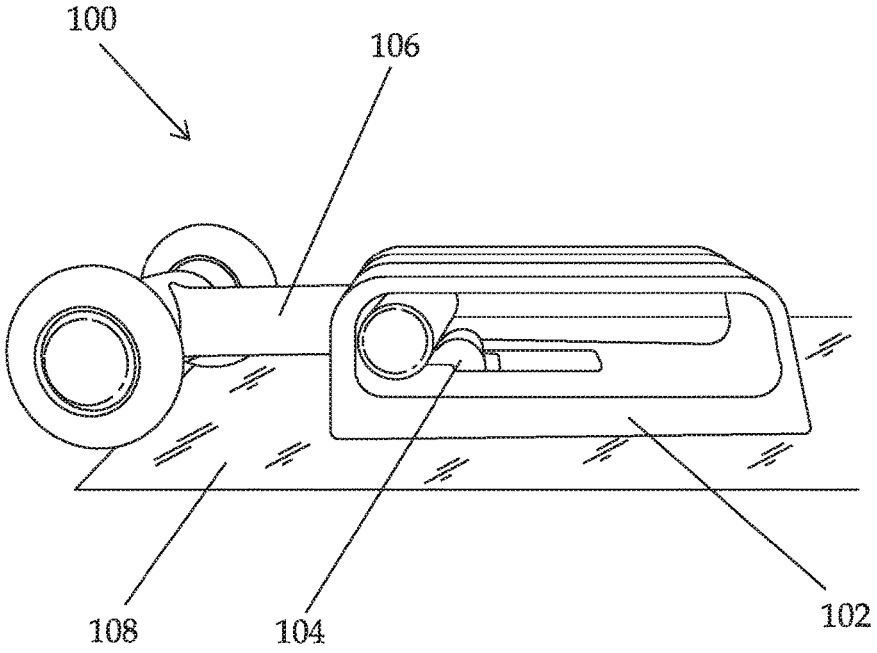
FIG. 2 depicts a side view of a strap connector attached to an article in accordance with embodiments of the present invention.

FIG. 2 depicts a side view of a strap connector 100 attached to an article 108 in accordance with embodiments of the present invention. The housing 102 and/or the bumper plate 104 may attach directly to the article 108. The t-bar 106 may comprise a first end adapted to couple with the housing 102 and a second end adapted to attach to a strap. The bumper plate 104 may be adapted to secure one end of the t-bar 106 at an end portion of the housing 102. The bumper plate 104 may comprise a portion that protrudes through the housing 102 to secure the end of the t-bar 106 at the end and/or a secure portion of the housing 102. In some embodiments, multiple bumpers 104 and/or t-bars 106 may be included. An exemplary housing 102 is depicted in FIGS. 3A and 3B.

Figure 3A:
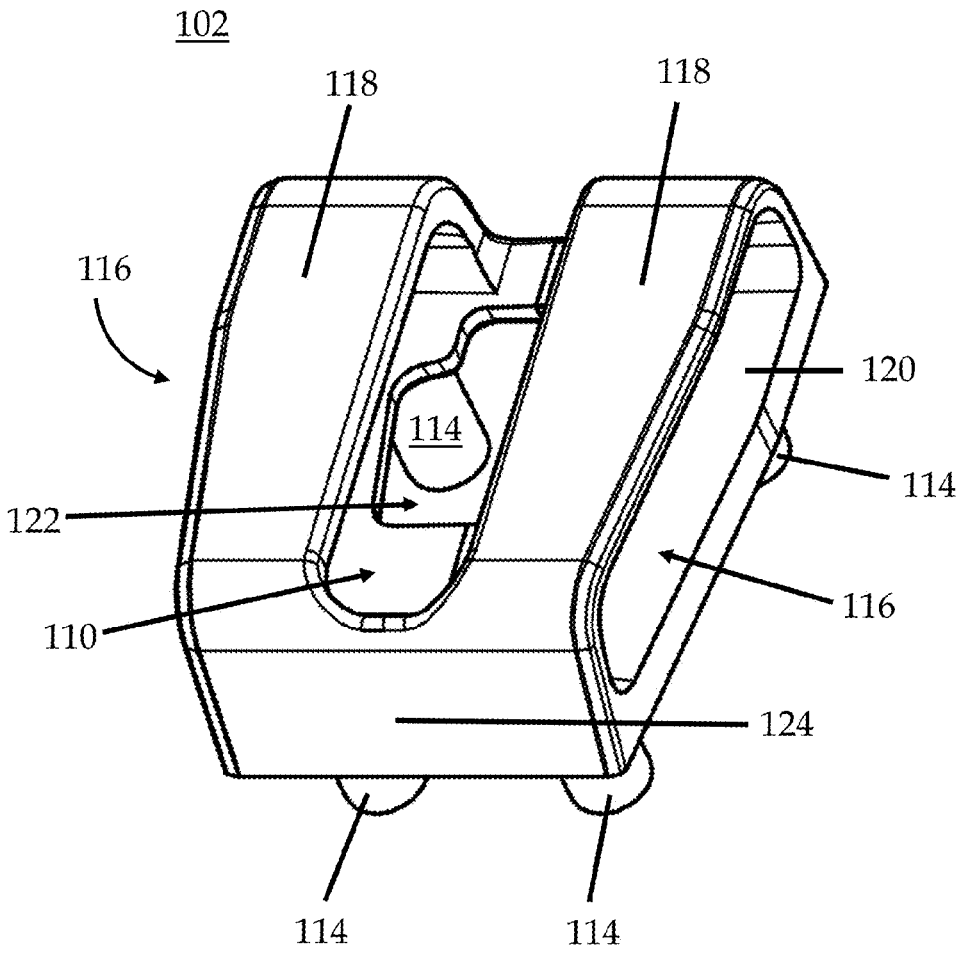
FIG. 3A depicts a perspective view of housing in accordance with embodiments of the present invention.
Figure 3B:
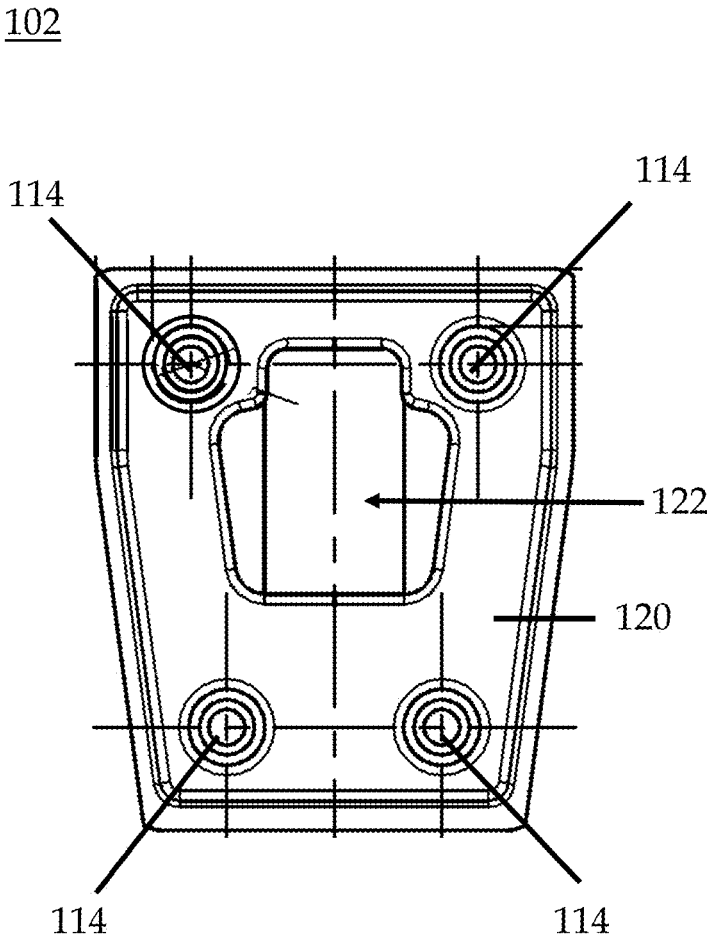
FIG. 3B depicts a bottom view of a housing in accordance with embodiments of the present invention.

FIG. 3A depicts a perspective view of housing 102 in accordance with embodiments of the present invention. The housing 102 may be adapted to house a t-bar in accordance with embodiments of the present invention. The housing 102 may allow the t-bar to slidably move within the housing 102 from a first end of the housing 102 to a second end of the housing 102. The housing 102 may attach directly to an article and/or be integral with the article. The housing 102 may also attach to an article through a bumper plate and/or be integral with a bumper plate. When a bumper plate is included, the bumper plate may be adapted to secure a t-bar at one end of the housing 102, for example, as depicted in FIGS. 1 and 2. The housing 102 may comprise a cavity 110, one or more legs 114, one or more side openings 116, one or more rails 118, a floor 120, a bumper aperture 122, and a rail connector 124.

The housing 102 may comprise a tapered shape, as depicted in the Figures, wherein a top portion of the housing 102 is wider than a bottom portion of the housing 102. The housing 102 may also comprise alternative shapes adapted to attach to an article and secure a t-bar in accordance with embodiments of the present invention. The housing 102 may comprise a sturdy material adapted to resist breaking and adapted to protect the t-bar housed within the housing. By way of example, the housing may comprise metal, such steel, iron, titanium, or the like. Alternatively, the housing may comprise a plastic, wood, or other materials adapted to resist breaking. The housing 102 may also comprise a combination of materials.

A cavity 110 may be formed within the housing 102 may be adapted to receive a t-bar in accordance with embodiments of the present invention. The cavity 110 may allow the t-bar to sit within the cavity 110 and slidably move from one end of the housing 102 to a second end of the housing 102. The cavity may be partially enclosed by one or more rails 118 and/or a rail connector 124. By way of example, the housing 102 may comprise two rails 118 adapted to allow a t-bar to fit between the rails 118 when the t-bar is inserted into the housing. The rails 118 may be disposed, for example, on outer lateral sides of the housing 102.

The rails 118 may also be adapted to contain the t-bar under the rails 118 and above a floor 120 of the housing 120, when the t-bar is coupled with the housing 102. The rails 118 may be adapted to resist the movement of the t-bar away from the floor 120 when the t-bar is coupled with the housing 102. The rails 118 may be attached to the floor 120 and may be attached to each other via a rail connector 124. The rails 118 may be integral with the housing 102 or may be detachably attached via a connector, such as frictionally fit mating member, a magnet assembly, and/or the like. Although two rails 118 are depicted in the figures, a single rail or more than two rails may be included in accordance with exemplary embodiments. For example, one, three, five, seven, or ten rails may be included. When more than two rails 118 are included, the housing 102 may be adapted to receive and/or support more than one t-bar.

The rail connector 124 may also be used to support the rails 118 and resist the movement of the t-bar when the t-bar is in contact with the rail connector 124. The rails 118 may be adapted to secure a portion of the t-bar between the rails 118 and a portion of the t-bar underneath each rail. Lateral movement of a t-bar may be restricted by the rails 118 when the t-bar is disposed between the rails. Movement away from the housing may be restricted when a portion of the t-bar is disposed underneath one or more of the rails 118. The rails 118 may be closed the outermost lateral sides of the housing 102 or may surround one or more side openings 116. The side openings 116 may have a length of approximately the majority of the length of the rails, or may comprise a shorter length.

The housing 102 may be adapted to directly attach to an article via the floor 120, or may be integral with the article. The housing 102 may be frictionally secured to the article, or in some embodiments, the housing 102 may be secured to the article with an adhesive, screws, rivets, other securing means, and/or the like. In some embodiments, the housing 102 may be attached to the article with one or more legs 114. The legs 114 may protrude from the floor 120 of the housing 102 underneath the housing 102. The legs 114 may be adapted to secure the housing 102 to the article, and may be adapted to restrict the movement of the housing 102 when attached to the article. The legs 114 may also be adapted to provide further support for the strap when the article is lifted by the strap. he legs 114 may generally be cylindrical, but may also be any other shape adapted to secure the housing 102 to an article.

FIG. 3B depicts a bottom view of a housing 102 in accordance with embodiments of the present invention. The housing 102 may comprise any number of legs 114 in accordance with exemplary embodiments. For example, the housing 102 may comprise four legs. Although four legs 114 are depicted in the figures, less or more than four legs may be included in exemplary embodiments of the present invention. For example, one, three, five, seven, or ten rails may be included. The legs 114 may be disposed on any location on the bottom of the floor 120 of the housing. By way of example, the legs 114 may be disposed at or near corners or edges of the housing 112. The housing 102 may also comprise a bumper aperture 122 for receiving a bumper. The bumper aperture 122 may be formed in the floor 120 and may be adapted to receive a bumper attached to a bumper plate. In alternative embodiments, a bumper may be integral with the floor. The bumper aperture 122 may comprise a contoured shape that may be narrower at the top and wider at the bottom. In some embodiments, the bumper aperture 122 may comprise a narrow opening at the top, a wider central portion, and a narrow bottom portion wider than the narrow opening at the top, for example, similar to the bumper aperture 122 depicted in FIG. 3B. The narrower portion of the bumper aperture 122 may be adapted to receive a bumper and the wider portion of the bumper aperture 122 may be adapted to be positioned over a platform of a bumper plate.

Figure 4A:
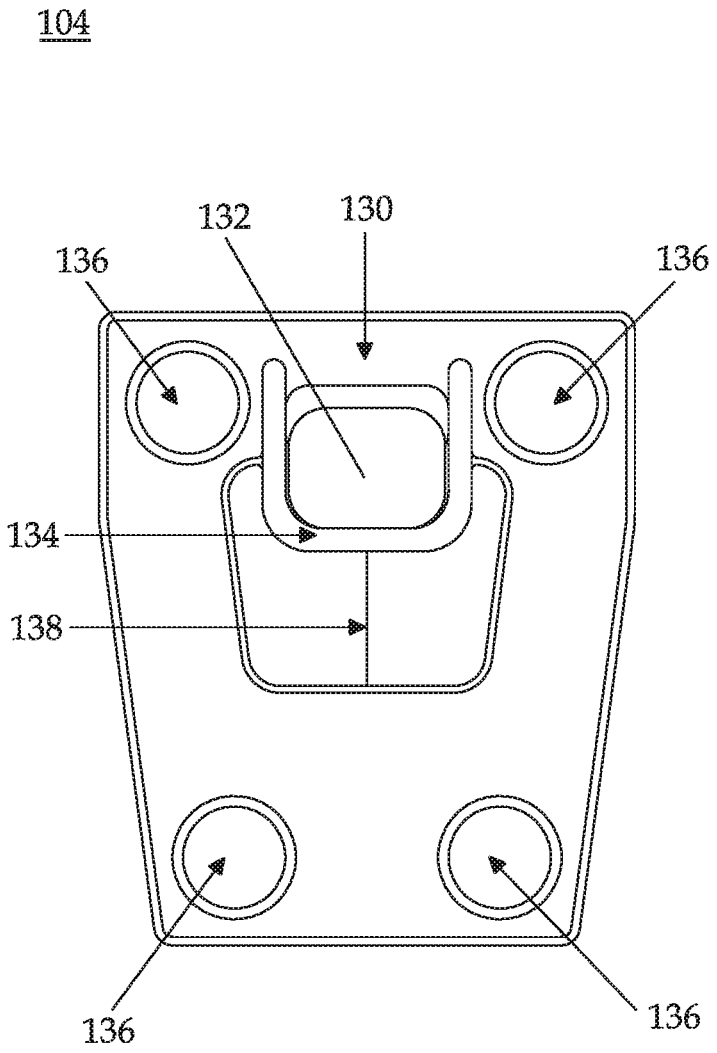
FIG. 4A depicts a top view of a bumper plate in accordance with embodiments of the present invention.

FIG. 4A depicts a top view of a bumper plate 104 in accordance with embodiments of the present invention. The bumper plate 104 may be adapted to secure to and/or be disposed on an article on one side and to a housing on another side. The bumper plate 104 may be adapted to be secured to the article via an adhesive or another securing means, such as a rivet, screw, and/or the like, and/or may be frictionally fit or secured by the housing. The bumper plate 104 may comprise a protrusion, such as a bumper 132 for securing a t-bar in a position within the housing. In some embodiments, the bumper plate 104 may comprise a tab 130, a bumper 132, a tab opening 134, leg openings 136, a platform 138, and/or the like. The leg openings 136 may be adapted to receive the legs of a housing in accordance with embodiments of the present invention. For example, the legs of a housing may extend through the leg openings 136 into an article, securing the bumper plate 104 to the article. The number, shape, and positioning of leg openings 136 may be equivalent and/or similar to the number, shape, and positioning of corresponding legs on a housing.

The bumper plate 104 may comprise a tapered shape, for example, as depicted in the Figures, wherein a top portion of the bumper plate 104 is wider than a bottom portion of the bumper plate 104. The bumper plate 104 may also comprise alternative shapes adapted to attach to an article and secure a t-bar in accordance with embodiments of the present invention. The bumper plate 104 may comprise a sturdy material adapted to resist breaking and adapted to protect the t-bar housed within the housing. By way of example, the housing may comprise metal, such a steel, iron, titanium, or may comprise a plastic, wood, or other materials adapted to resist breaking. In some embodiments, the bumper plate 104 may comprise a bendable material, such as a plastic. The bumper plate 104 may also comprise a combination of materials.

The bumper plate 104 may comprise a bumper 132 adapted to fit within an aperture of a housing in accordance with exemplary embodiments of the present invention. The bumper 132 may protrude from the bumper plate 104 and may be adapted to secure a t-bar in a location within a housing. The bumper 132 may comprise rounded edges, or may comprise square or semi-square edges. The bumper 132 may be positioned on the bumper plate such that the bumper 132 is aligned with a bumper aperture of a housing in accordance with embodiments of the present invention. The bumper 132 may be formed on and/or attached to the surface of the bumper plate 104. In some embodiments, the bumper 132 may be disposed on a tab 130 formed in the bumper plate 104. The tab 132 may be attached to the bumper plate 104 and may be surrounded by a tab opening 134. The tab 132 may be attached to the bumper plate 104 at along an edge of the tab 132, such that the tab may be resiliently bendable along the edge and may move above or below the bumper plate 104 when force is applied to the tab 130.

In some embodiments of the present invention, when a t-bar is rolled, slid, moved, or pressed over the bumper 132, the tab 130 may extend at least partially below the bumper plate 104 such that the t-bar has room to move over the bumper 132 into a secured position behind the bumper 132 above the tab 130. When the t-bar is moved into a secured position, the bumper 132 may be adapted to secure the t-bar in the secured position until a force is exerted on the bumper 132 such that the tab 130 moves at least partially below the surface of the bumper plate 104. When the tab 130 moves at least partially below the surface of the bumper plate 104, a t-bar may be allowed to move back over the bumper and slidably move within the housing. In some embodiments, the tab 130 may also comprise a depression between the bumper 132 and the bendable edge. The depression may be adapted to allow the t-bar to sit within the depression and restrict movement of the t-bar.

Figure 4B:
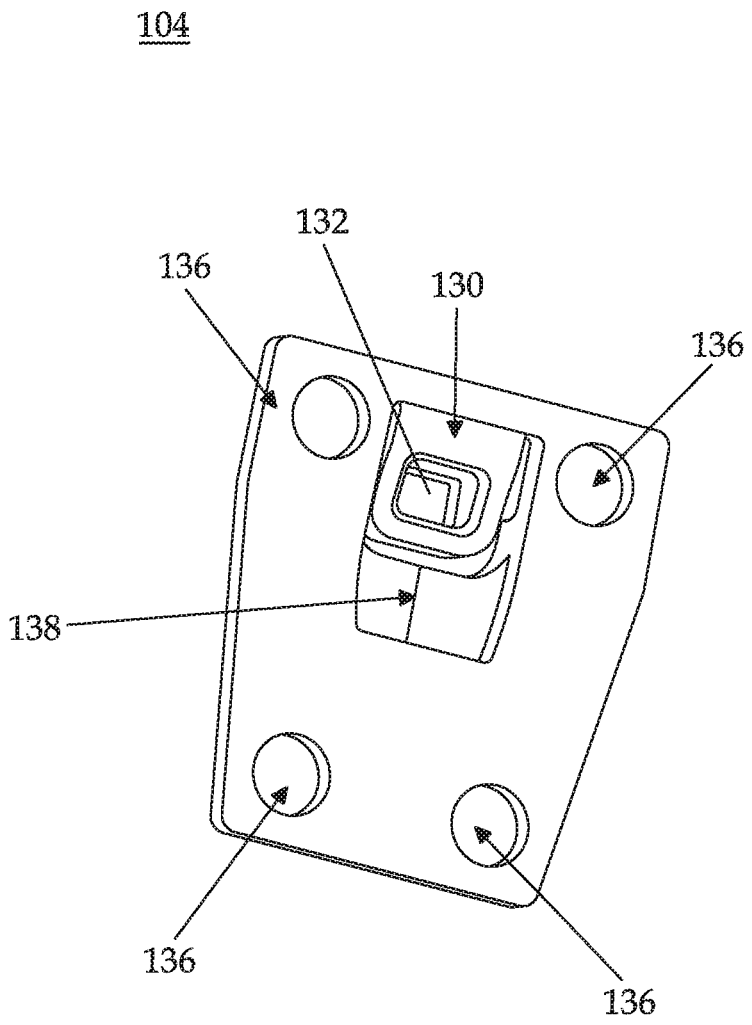
FIG. 4B depicts a back perspective view of a bumper plate in accordance with embodiments of the present invention.

FIG. 4B depicts a back perspective view of a bumper plate in accordance with embodiments of the present invention. The tab 130 may be positioned in the same horizontal plane as the bumper plate 104 or may be positioned at a different angle. For example, the tab 130 may be angled above the surface of the bumper plate 104. The bumper 132 may be substantially hollow or may comprise solid material. In some embodiments, the platform 138 may be recessed from a top surface of the bumper plate and may comprise a convex shape having an apex. In some embodiments, the apex of the platform 138 may be disposed in the horizontal center of the platform 138, or in other locations in accordance with the present invention.

Figure 5:
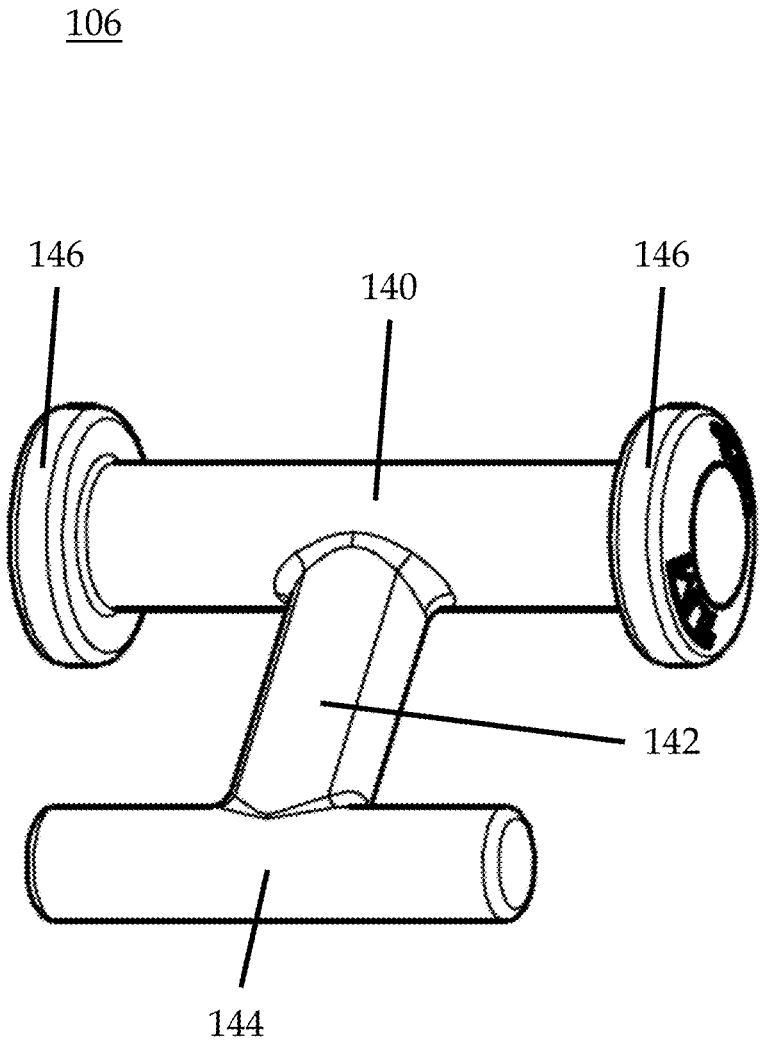
FIG. 5 depicts a perspective view of a t-bar in accordance with embodiments of the present invention.

FIG. 5 depicts a perspective view of a t-bar 106 in accordance with embodiments of the present invention. In exemplary embodiments, a t-bar 106 may be adapted to be secured to a strap via a top bar 140 and secured to an article via a bottom bar 144. The bottom bar 144 may be adapted to fit within, and/or couple with, a housing in accordance with exemplary embodiments of the present invention. The t-bar 106 may be adapted to connect a strap to an article, and allow the strap to rotate about an axis passing through a bottom bar 144 of the t-bar 106. The t-bar 106 may be adapted to support the weight of the article.

The t-bar 106 may comprise a top bar 140, a t-bar connector 142, a bottom bar 144, and retaining ends 146. The top bar 140 may be adapted to couple with and/or attach to a strap. The top bar 140 may comprise a cylinder or may comprise any shape adapted to hold a strap in accordance with embodiments of the present invention. The t-bar connector 142 may be adapted to attach the top bar 140 to the bottom bar 144. The t-bar connector may comprise a length adapted to allow the t-bar 106 to rotate around an axis passing through the bottom bar 144. The retaining ends 146 may be adapted to secure a strap on the top bar 140 such that the strap may not slide off the lateral sides of the top bar 140. In some instances, a strap may be split and may connect with the top bar 140 on either or both sides of the t-bar connector 142. The bottom bar 144 may be adapted to attach with and/or couple with a housing. The bottom bar 144 may comprise a cylinder or any shape adapted to fit within the housing. The t-bar 106 may comprise a material adapted to support the weight of an article and resist breaking. For example, the t-bar 106 may comprise a metal, or the like. In exemplary embodiments, the t-bar connector 142 may be cylindrical, or may be of any shape adapted to allow the t-bar 106 to sidably move between rails of a housing.

Figure 6:
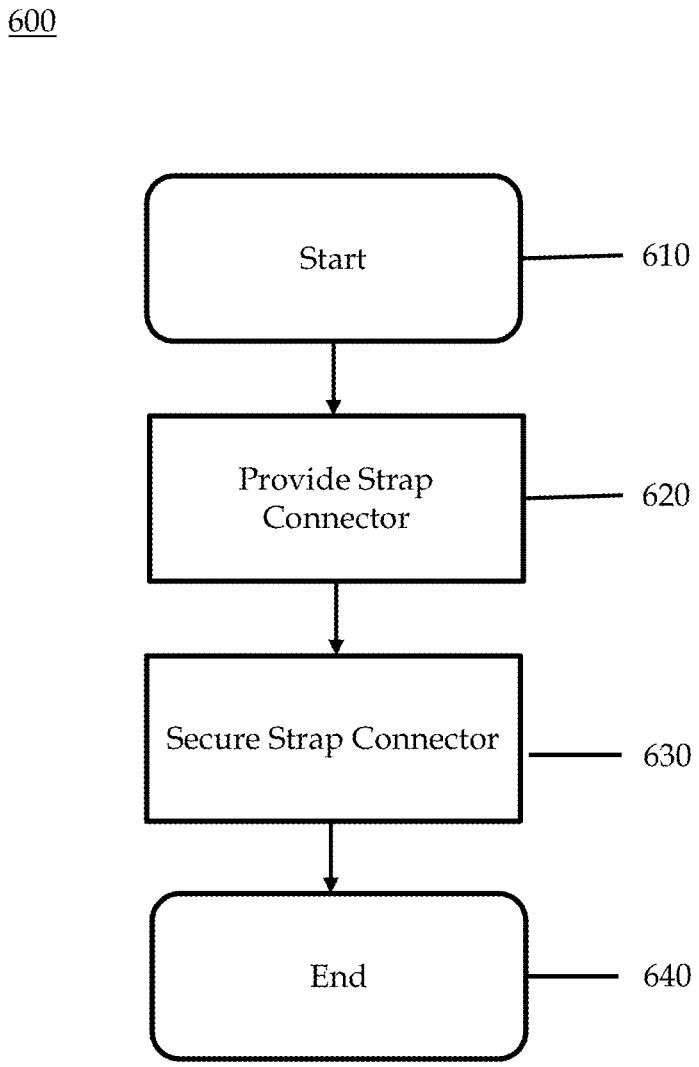
FIG. 6 depicts a flowchart of a method of using a strap connector in accordance with embodiments of the present invention.

FIG. 6 depicts a flowchart of a method of using a strap connector in accordance with embodiments of the present invention. The method begins at step 610. For ease, the method 600 is described herein with reference to the strap connector 100 examples illustrated in FIGS. 1-5. At step 620, a strap connector 100 is provided. In exemplary embodiments, the strap connector 100 may comprise a housing 102, a bumper plate 104, and a t-bar 106.

In exemplary embodiments, at step 630 the strap connector 100 may be secured to a strap on one end and secured to an article on another end. The strap connector may be secured to an article by placing the bumper plate 104 on the article and placing the legs 114 of the housing 102 in the leg openings 136 of the bumper plate 104 and into the surface of the article. The housing 102 and the bumper plate 104 may also be secured to the article with an adhesive or other securing means such as screws, rivets, or the like, or may be frictionally fitted within a recess in the article. The entire strap connector 100, or part of the strap connector 100, may be disposed below a surface of an article, or may sit on top of the surface of an article. The t-bar 106 may be secured to the strap by placing the strap around the top bar 140 of the t-bar 106. The t-bar may be secured to the housing by placing the bottom bar 144 in the cavity 110 of the housing 102 and/or under rails 118. When the t-bar 106 is within the housing 102, the t-bar 106 may be slidably moved into a secured position by moving the t-bar through the cavity 100 over the bumper 132 of the bumper plate 104. When the t-bar 106 is secured to the strap and to the article, the strap may be used to lift the article. When the strap is no longer required, it can be removed from the housing 102 by moving the bottom bar 144 over the bumper 132 and removing the t-bar 106 from the housing 102. After the strap has been secured to the article via the strap connector 100, the method ends at step 640.

While the foregoing is directed to embodiments of the present invention, other and further embodiments of the invention may be devised without departing from the basic scope thereof. For example, although numerous embodiments having various features have been described herein, combinations of such various features in other combinations not discussed herein are contemplated within the scope of embodiments of the present invention.

What is claimed is:

1. A strap connector for connecting a strap to an article, the strap connector comprising:

a t-bar for attaching the strap to the article;

a housing for receiving the t-bar, the housing secured to the article, the housing comprising a floor;

a pair of rails for maintaining the t-bar within the housing, the pair of rails disposed on opposing lateral sides of the housing; and a depressible bumper for maintaining the t-bar in a position within the housing, the bumper protruding above a surface of the floor of the housing such that a top of the bumper sits below a bottom of the rails when in an undepressed state and receding below the surface of the floor of the housing when in a depressed state responsive to a downward force being applied to the bumper.

2. The strap connector of claim 1, further comprising:

a tab supporting the bumper;

one or more legs for securing the housing to the article one or more leg openings for receiving the one or more legs of the housing; and wherein the bumper is positioned substantially between the housing and the article.

3. The strap connector of claim 2, wherein the tab is attached to the bumper along an edge of the tab, wherein the tab is resiliently bendable along the edge.

4. The strap connector of claim 2, wherein the one or more legs protrude from a bottom surface of the housing.

5. The strap connector of claim 1, wherein the t-bar comprises:

a top bar adapted to attach to the strap;

a bottom bar adapted to couple with the housing;

a t-bar connector adapted to attach the top bar and the bottom bar.

6. The strap connector of claim 5, wherein the top bar comprises retaining ends for securing a strap on the top bar and resisting lateral movement of the strap.

7. The strap connector of claim 1, wherein the housing is adapted allow the t-bar to slidably move within the housing from a first end of the housing to a second end of the housing.

8. The strap connector of claim 1, wherein a top portion of the housing is wider than a bottom portion of the housing.

9. The strap connector of claim 1, wherein the housing comprises at least one of metal, plastic, or wood.

10. The strap connector of claim 1, wherein a top portion of the bumper plate is wider than a bottom portion of the bumper plate.

11. The strap connector of claim 1, wherein the pair of rails extends at least the entire length of the housing.

12. The strap connector of claim 1, wherein the pair of rails comprises a first end and a second end, the first end being configured to attach to the housing at a first plane and the second end being configured to attach to the housing at a second plane.

13. The strap connector of claim 1, wherein the bumper comprises a rounded shape.

14. The strap connector of claim 1, wherein the bumper comprises a ramped shape.

15. A strap connector for connecting a strap to an article, the strap connector comprising:

a t-bar for attaching the strap to the article, the t-bar comprising a top bar adapted to attach to the strap, a bottom bar adapted to couple with a housing; and a t-bar connector adapted to attach the top bar and the bottom bar, wherein the housing comprises a floor and rails for maintaining the bottom bar within the housing and maintaining the t-bar connector between the rails such that the bottom bar is located entirely below the rails a bumper plate for maintaining the t-bar in a position within the housing, the bumper plate positioned between the housing and the article, the bumper plate comprising a bumper protruding above the surface of the floor of the housing.

16. The strap connector of claim 15, wherein the top bar comprises retaining ends for securing a strap on the top bar and resisting lateral movement of the strap.

17. The strap connector of claim 15, wherein the housing is adapted allow the t-bar to slidably move within the housing from one end of the housing to a second end of the housing.

18. The strap connector of claim 15, wherein the housing further comprises:

a cavity for receiving a portion of the t-bar;

one or more legs for securing the housing to the article;

a bumper aperture for receiving the bumper, the bumper aperture formed in the floor of the housing; and a rail connector for attaching the rails at one end.

19. The strap connector of claim 18, wherein the one or more legs protrude from a bottom surface of the housing.

20. The strap connector of claim 15, wherein the strap connector further comprises:

a tab supporting the bumper; and one or more leg openings for receiving the one or more legs.

21. The strap connector of claim 20, wherein the tab is attached to the bumper plate along an edge of the tab, wherein the tab is resiliently bendable along the edge, and wherein the tab is adapted to move below the bumper plate when downward force is applied to the tab.

22. A method of securing a strap to an article, the method comprising:

providing a strap connector comprising:

a t-bar for attaching the strap to the article;

a housing for receiving the t-bar, the housing secured to the article, the housing comprising a floor and rails for maintaining the t-bar within the housing; and a depressible bumper for maintaining the t-bar in a secure position within the housing, the bumper protruding above a surface of the floor of the housing such that a top of the bumper sits below a bottom of the rails when in an undepressed state and receding below the surface of the floor of the housing when in a depressed state responsive to a downward force being applied to the bumper;

attaching the strap to the t-bar; and attaching the t-bar to the housing.

23. The method of claim 22, further comprising sliding the t-bar over the bumper and securing the t-bar in the secure position within the housing.

24. The method of claim 22, wherein providing the strap connector further comprises a pair of rails for maintaining the t-bar within the housing, the pair of rails disposed on opposing lateral sides of the housing.

25. The method of claim 24, wherein the pair of rails extends at least the entire length of the housing.

26. The method of claim 24, wherein the pair of rails comprises a first end and a second end, the first end being configured to attach to the housing at a first plane and the second end being configured to attach to the housing at a second plane.

* * * * *